US005269815A

United States Patent [19]

Schlenker et al.

[11] Patent Number: 5,269,815

[45] Date of Patent: Dec. 14, 1993

[54] PROCESS FOR THE FLUORESCENT WHITENING OF HYDROPHOBIC TEXTILE MATERIAL WITH DISPERSE FLUORESCENT WHITENING AGENTS FROM SUPER-CRITICAL CARBON DIOXIDE

[75] Inventors: Wolfgang Schlenker; Dieter Werthemann, both of Basel, Switzerland; Claude Eckhardt, Riedisheim, France

[73] Assignee: Ciba-Geigy Corporation, Ardsley, N.Y.

[21] Appl. No.: 976,243

[22] Filed: Nov. 13, 1992

[30] Foreign Application Priority Data

Nov. 20, 1991 [CH] Switzerland ..... 3390/91

[51] Int. Cl.[5] ..... C09K 11/06; D06P 3/54

[52] U.S. Cl. ..... 8/475; 8/473; 8/648; 8/922; 252/301.21; 252/301.22; 252/301.23; 252/301.24

[58] Field of Search ..... 8/475, 648; 252/301.21, 252/301.22, 301.23

[56] References Cited

U.S. PATENT DOCUMENTS

| | | | |
|---|---|---|---|
| 4,940,469 | 7/1990 | Mockel et al. | 8/527 |
| 5,051,111 | 9/1991 | Anceschi et al. | 8/648 |
| 5,199,956 | 4/1993 | Schlenker et al. | 8/473 |

FOREIGN PATENT DOCUMENTS

| | | |
|---|---|---|
| 323399 | 7/1989 | European Pat. Off. . |
| 328485 | 8/1989 | European Pat. Off. . |
| 474598 | 3/1992 | European Pat. Off. . |
| 474599 | 3/1992 | European Pat. Off. . |
| 474600 | 3/1992 | European Pat. Off. . |
| 514337 | 11/1992 | European Pat. Off. . |
| 3904514 | 8/1990 | Fed. Rep. of Germany . |
| 4004111 | 8/1990 | Fed. Rep. of Germany . |
| 3906724 | 9/1990 | Fed. Rep. of Germany . |
| 3906735 | 9/1990 | Fed. Rep. of Germany . |

OTHER PUBLICATIONS

J. Hyatt, J. Org. Chem., 1984, 49, 5097–5101.

*Primary Examiner*—A. Lionel Clingman

*Attorney, Agent, or Firm*—Marla J. Mathias; George R. Dohmann

[57] ABSTRACT

A process for the fluorescent whitening of hydrophobic textile materials, especially polyesters, wherein the textile material is treated with disperse fluorescent whitening agents in supercritical $CO_2$.

25 Claims, No Drawings

PROCESS FOR THE FLUORESCENT WHITENING OF HYDROPHOBIC TEXTILE MATERIAL WITH DISPERSE FLUORESCENT WHITENING AGENTS FROM SUPER-CRITICAL CARBON DIOXIDE

The present invention relates to a process for the fluorescent whitening of hydrophobic textile material with disperse fluorescent whitening agents.

Hydrophobic textile materials are usually whitened from aqueous liquors. This never results in complete exhaustion of the bath, i.e., the fluorescent whitening agents do not show quantitative exhaustion onto the textile material. This in turn has the effect that the whitening liquor remaining after whitening still contains, depending on the particular fluorescent whitening agents and substrates, certain amounts of fluorescent whitening agent. This results in relatively large amounts of waste water, the purification of which requires a large expenditure.

The object of the present invention is to provide a process for the fluorescent whitening of textile material, in which process no waste water or no significant amounts of waste water are formed.

This object is achieved by the process according to the invention.

Accordingly, the present invention relates to a process for the fluorescent whitening of hydrophobic textile material with fluorescent whitening agents, wherein the textile material is treated with a fluorescent whitening agent in supercritical carbon dioxide.

The process according to the invention intends to use, instead of the aqueous liquors described above, whitening liquors in which the water has been replaced by supercritical carbon dioxide, i.e. $CO_2$ whose pressure and temperature are above the critical pressure and the critical temperature. The viscosity of this supercritical $CO_2$ is approximately that of the corresponding gas and its density is approximately comparable to that of the correspondingly liquefied gas.

The process according to the invention has a number of advantages. Owing to the fact that the supercritical $CO_2$ used in this process does not enter the waste water but is used again after whitening, no waste water pollution takes place in the process according to the invention. Furthermore, the mass transfer of processes necessary for whitening the textile substrate take place in the process according to the invention at a much higher rate than in aqueous systems. This in turn has the effect that the flow through the textile substrate can be particularly effective and rapid. When the process according to the invention is used, for example, for the whitening of wound packages, no non-uniformities with respect to the flow through the wound package are observed. When disperse whitening agents are used, unwanted agglomerations on the fibre material, such as is occasionally the case with customary aqueous processes, are virtually absent, as a result of which spotting can be avoided by using the process according to the invention.

A further advantage of the process according to the invention is that it is possible to use disperse fluorescent whitening agents which exclusively consist of the actual whitening agent and do not contain the customary dispersants and diluents.

The fluorescent whitening agents used in the process according to the invention are water-insoluble compounds containing two identical or different radicals selected from the group consisting of styryl, stilbenyl, naphthotriazolyl, benzoxazolyl, coumarin, naphthalimide, pyrene and triazinyl which are linked to one another directly or via a bridging member selected from the group consisting of vinylene, styrylene, stilbenylene, thienylene, phenylene, naphthylene and oxadiazolylene.

Fluorescent whitening agents which are particularly suitable for the process according to the invention are:

a) distyrylbenzenes of the formula (1)

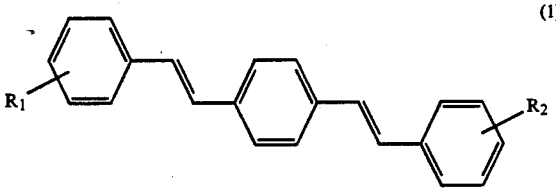

in which $R_1$ and $R_2$, independently of one another, are each H, CN or $SO_2$—$C_1$-$C_4$alkyl;

b) vinylstilbenes of the formula (2)

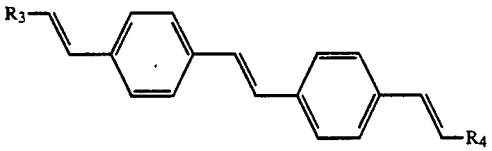

in which $R_3$ and $R_4$, independently of one another, are each CN or COO—$C_1$-$C_4$alkyl;

c) stilbenylnaphthotriazoles of the formula (3)

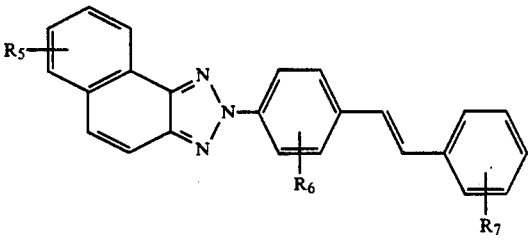

in which $R_5$, $R_6$ and $R_7$, independently of one another, are each H, $C_1$-$C_4$alkyl, halogen or CN;

d) stilbenylbenzoxazoles of the formula (4)

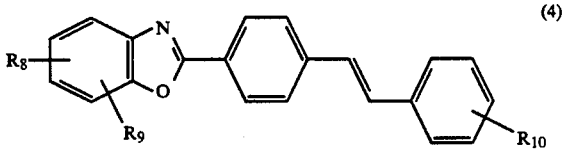

in which $R_8$ and $R_9$, independently of one another, are each H or $C_1$-$C_6$alkyl and $R_{10}$ is $C_1$-$C_4$alkyl, $C_1$-$C_4$alkenyl, phenyl or $C_1$-$C_4$alkylphenyl;

e) bis(benzoxazoles) of the formula (5)

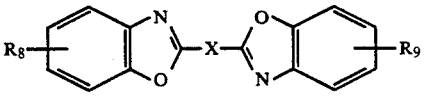

in which $R_8$ and $R_9$, independently of one another, are each H or $C_1$–$C_6$alkyl and X is vinylene, thienylene, naphthylene, styrylene or stilbenylene;

f) coumarins of the formula

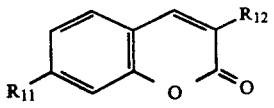

(6)

in which $R_{11}$ and $R_{12}$, independently of one another, are each a phenyl or pyrazolyl radical or a radical of the formula

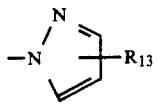

(7)

or

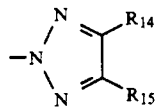

(8)

in which $R_{13}$ is $C_1$–$C_6$alkyl, phenyl or halogen and $R_{14}$ and $R_{15}$, independently of one another are each $C_1$–$C_6$alkyl or -alkoxy, phenyl or halogen, or in which $R_{14}$ and $R_{15}$ together with the C atoms linking them are a phenyl or naphthyl radical;

g) naphthalimides of the formula

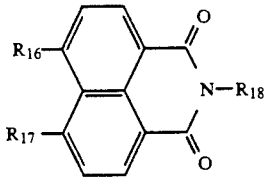

(9)

in which $R_{16}$, $R_{17}$ and $R_{18}$, independently of one another, are each H, $C_1$–$C_{10}$alkyl or -alkoxy;

h) triazines of the formula

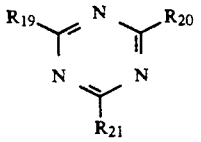

(10)

or

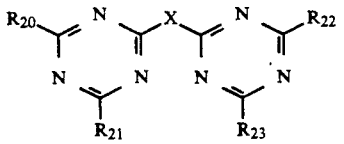

(11)

in which $R_{19}$ is pyrenyl, $R_{20}$, $R_{21}$, $R_{22}$ and $R_{23}$, independently of one another, are each $C_1$–$C_6$alkyl or -alkoxy, phenyl, $C_1$–$C_4$alkylphenyl or $C_1$–$C_4$alkoxyphenyl and X is vinylene, thienylene, naphthylene, styrylene or stilbenylene;

i) styrylbenzoxazoles of the formula

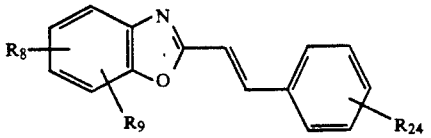

(12)

in which $R_8$ and $R_9$, independently of one another, are each H or $C_1$–$C_4$alkyl and $R_{24}$ is CN, phenyl or COOC-$_1$–$C_4$alkyl;

j) distyrylbiphenyls of the formula

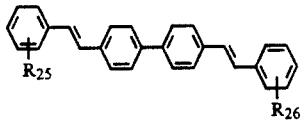

(13)

in which $R_{25}$ and $R_{26}$ are each H, $C_1$–$C_4$alkyl or -alkoxy.

According to the invention, alkyl radicals are in general understood to mean straight-chain, branched or cyclic alkyl groups. Examples of these are methyl, ethyl, propyl, i-propyl, butyl, i-butyl, tert-butyl, amyl, tert-amyl (1,1-dimethylpropyl), 1,1,3,3-tetramethylbutyl, hexyl, 1-methylpentyl, neopentyl, 1-,2- or 3-methylhexyl, heptyl, n-octyl, tert-octyl, 2-ethylhexyl, n-nonyl, isononyl, decyl, cyclopentyl, cyclohexyl, methylcyclohexyl and the isomers belonging thereto. The non-cyclic alkyl radicals preferably contain 1 to 6 C atoms, in particular 1 to 4 C atoms.

These alkyl radicals can be substituted, for example by halogen, hydroxyl, alkoxy, cyano or phenyl. Examples of such substituted alkyl radicals are hydroxyethyl, methoxymethyl, ethoxyethyl, cyanoethyl, propoxypropyl, benzyl, chloroethyl or cyanoethyl.

Suitable alkoxy radicals are preferably those having 1 to 4 C atoms, for example methoxy, ethoxy, propoxy, iso-propoxy, n-butoxy, iso-butoxy or tert-butoxy.

The phenyl radicals can also be substituted, for example by chlorine, bromine, $C_1$–$C_4$alkyl, $C_1$–$C_4$alkoxy, nitro or cyano.

Halogen is fluorine, iodine, bromine or, in particular, chlorine.

Owing to their good properties in the process according to the invention, the fluorescent whitening agents mentioned in the examples are very particularly preferred.

The fluorescent whitening agents of formulae (1) to (13) are known or can be prepared in a manner known per se.

The process according to the invention is suitable for the fluorescent whitening of semisynthetic and, in particular, synthetic hydrophobic fibre materials, in particular textile materials. Textile materials made of blended fabrics containing such semisynthetic or synthetic hydrophobic textile materials can also be subjected to fluorescent whitening by the process according to the invention.

Suitable semisynthetic textile materials are in particular secondary cellulose acetate and cellulose triacetate.

Synthetic hydrophobic textile materials consist in particular of linear, aromatic polyesters, for example those consisting of terephthalic acid and glycols, in particular ethylene glycol, or condensation products prepared from terephthalic acid and 1,4-bis(hydroxymethyl)cyclohexane; of polycarbonates, for example of α,α-dimethyl-4,4'-dihydroxydiphenylmethane and phosgene, of fibres based on polyvinyl chloride, polypropylene or polyamide, for example nylon 6.6, nylon 6.10, nylon 6, nylon 11, poly(1,4-phenyleneterephthalamide) or poly(1,3-phenyleneisophthalamide).

The temperature employed in the process according to the invention depends essentially on the substrate. Usually, it is approximately between 90° and 200° C., preferably between about 100° and 150° C.

The pressure to be employed must have at least such a high value that $CO_2$ is present in a supercritical state. Preferably, the pressure is between about 73 and 400 bar, in particular between about 150 and 250 bar. At the preferred temperature of about 130° C. for the fluorescent whitening of polyester material, the pressure is about 200 bar.

The fluorescent whitening agents are preferably applied in a concentration of 0.001 to 2% by weight, in particular 0.005 to 0.5% by weight, relative to the weight of the textile material. Mixtures of two or more of the fluorescent whitening agents mentioned can also be used.

The "liquor ratio" (weight ratio of $CO_2$ to textile material) in the fluorescent whitening by the process according to the invention depends on the material to be treated and its make-up. It usually varies between a value of 2:1 to 100:1, preferably about 5:1 to 75:1. If, for example, polyester yarns wound onto suitable cheeses are to be subjected to fluorescent whitening by the process according to the invention, this whitening preferably takes place at relatively short liquor ratios, i.e., liquor ratios of between 2:1 to 5:1. As a rule, such short liquor ratios lead to difficulties in the aqueous system of the customary process, since, due to the high concentration of fluorescent whitening agent, there is often a risk that the finely disperse systems will agglomerate. However, in the process according to the invention, this does not occur.

There are several possibilities of purifying the supercritical $CO_2$ after whitening. For example, the residual whitening agent remaining in the supercritical $CO_2$ can be adsorbed or absorbed via suitable filters. The silica gel, kieselguhr, carbon, zeolite and alumina filters known per se are particularly suitable for this.

Another possibility is to remove the whitening agents remaining in the supercritical $CO_2$ after fluorescent whitening by a decrease in temperature and/or pressure and/or an increase in volume. This converts the supercritical $CO_2$ into the corresponding gas, which is then trapped and, after being converted into the supercritical state, used again for the whitening of further substrates. In this treatment, the fluorescent whitening agents are deposited in liquid or solid form and can be collected in a suitable manner and reused.

The process according to the invention produces very substantial white effects on the textile material, which are comparable to those obtained by the aqueous processes customary in the textile industry. The lightfastness properties are also equivalent to those obtained by customary application processes.

The examples which follow illustrate the invention without limiting it thereto.

EXAMPLE 1

7.3 mg of the fluorescent whitening agent of the formula

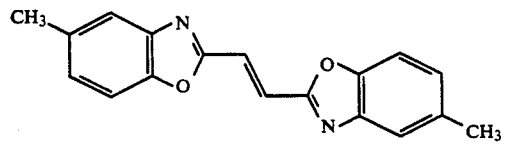

are initially introduced into an autoclave. A 5.16 g strip of polyester fabric is attached to a material support in the autoclave. After sealing the autoclave, 360 g of $CO_2$ are introduced into the autoclave from a storage bottle. The mixture is then heated to 130° C., as a result of which the pressure in the autoclave increases to 220 bar. After a dwell period of 30 minutes at this temperature, the apparatus is cooled, and the polyester fabric is removed. After this treatment, it is identical to a sample whitened in the usual manner.

EXAMPLES 2 to 9

The procedure of Example 1 is repeated, except that the fluorescent whitening agents listed in the table below are used, likewise giving fabrics whose properties are identical to those whitened by customary processes.

| Ex. | Fluorescent whitening agent |
|---|---|
| 2 | 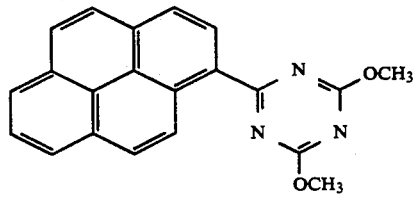 |
| 3 | 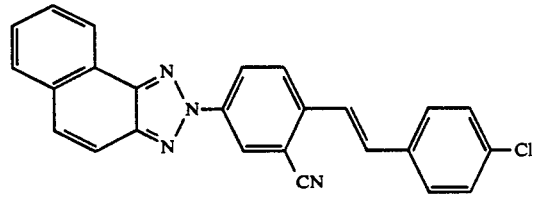 |

-continued
| Ex. | Fluorescent whitening agent |
|---|---|
| 4 | 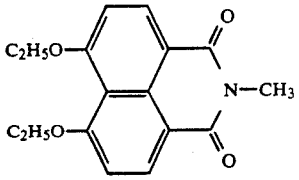 |
| 5 | 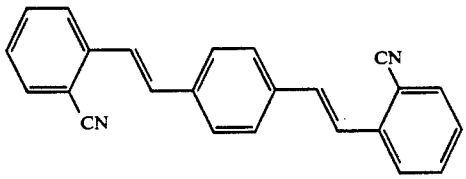 |
| 6 | 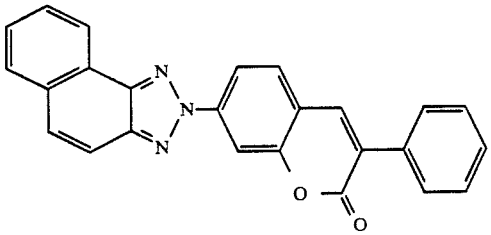 |
| 7 | 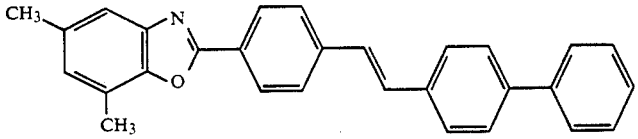 |
| 8 | 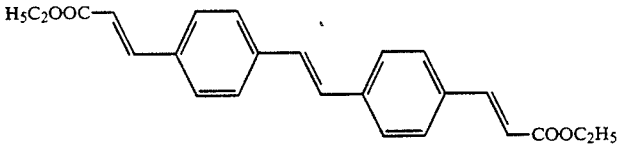 |
| 9 | 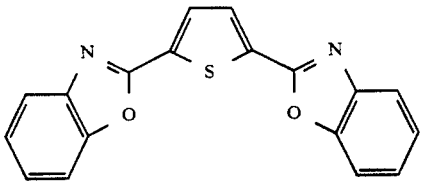 |
| 10 | 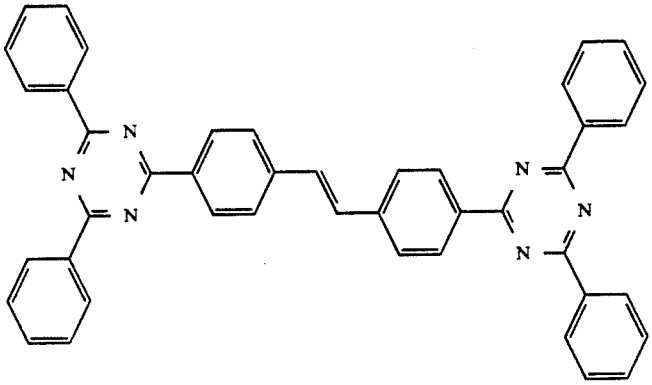 |

-continued
| Ex. | Fluorescent whitening agent |
|---|---|
| 11 | 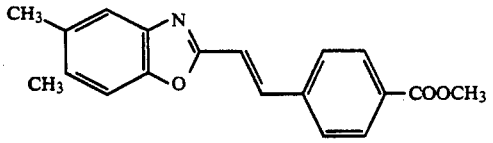 |
| 12 | 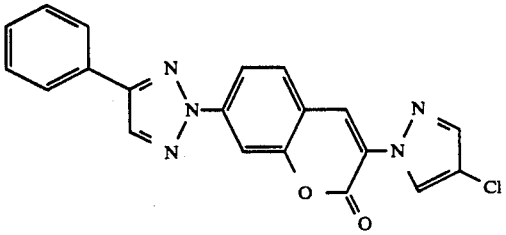 |
| 13 | 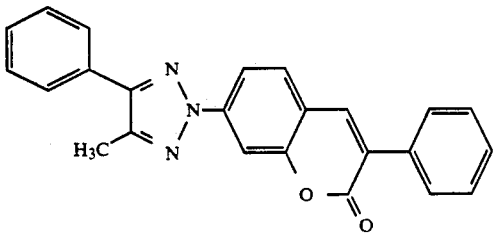 |
| 14 | 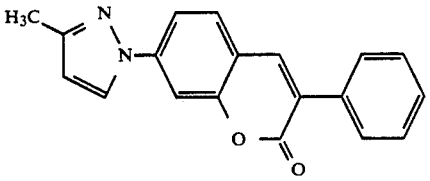 |
| 15 | 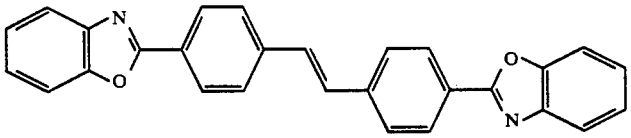 |
| 16 | 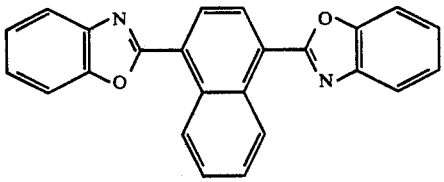 |
| 17 | 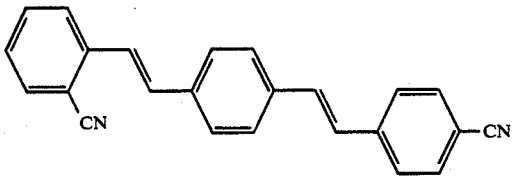 |

-continued

| Ex. | Fluorescent whitening agent |
|---|---|
| 18 | 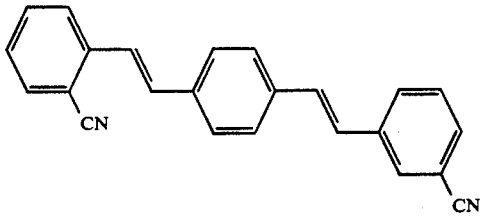 |
| 19 | 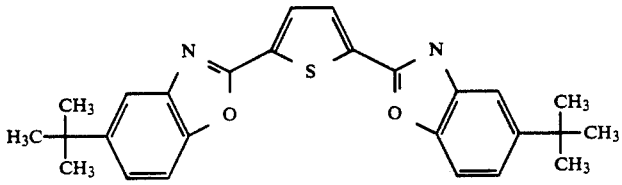 |
| 20 | 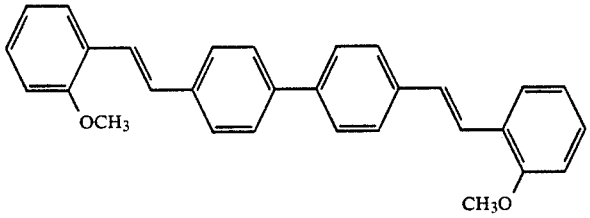 |

What is claimed is:

1. A process for the fluorescent whitening of a hydrophobic textile material, which comprises treating the textile material with a fluorescent whitening agent in supercritical carbon dioxide.

2. A process according to claim 1, wherein the fluorescent whitening agent used is a water-insoluble compound containing two identical or different radicals selected from the group consisting of styryl, stilbenzyl, naphthotriazolyl, benzoxazolyl, coumarin, naphthalimide, pyrene and triazinyl which are linked to one another directly or via a bridging member selected from the group consisting of vinylene, styrylene, stilbenylene, thienylene, phenylene, napthylene and oxadiazolylene.

3. A process according to claim 1, wherein the fluorescent whitening agent is from one of the following classes:

a) distyrylbenzenes of the formula (1)

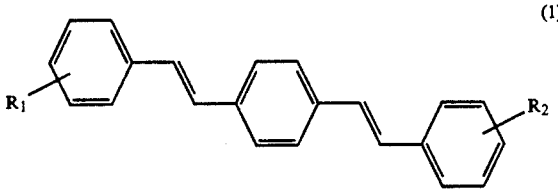

in which $R_1$ and $R_2$, independently of one another, are each H, CN or $SO_2$—$C_1$-$C_4$alkyl;

b) vinylstilbenes of the formula (2)

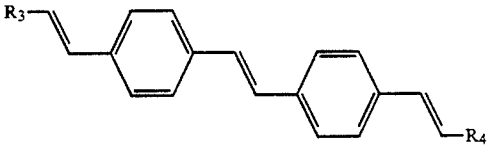

in which $R_3$ and $R_4$, independently of one another, are each CN or COO—$C_1$-$C_4$alkyl;

c) stilbenylnaphthotriazoles of the formula (3)

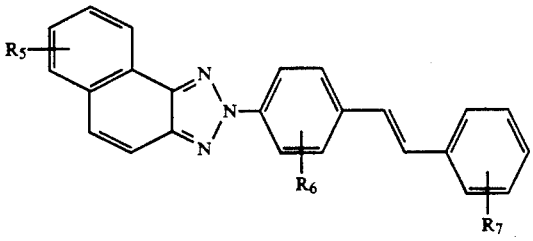

in which $R_5$, $R_6$ and $R_7$, independently of one another, are each H, $C_1$-$C_4$alkyl, halogen or CN;

d) stilbenylbenzoxazoles of the formula (4)

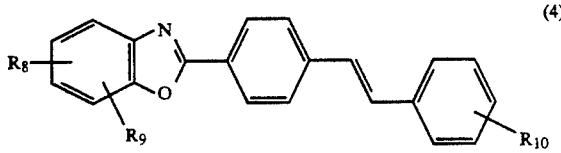

in which $R_8$ and $R_9$, independently of one another, are each H or $C_1$-$C_6$alkyl and $R_{10}$ is $C_1$-$C_4$alkyl, $C_1$-$C_4$alkenyl, phenyl or $C_1$-$C_4$alkylphenyl;

e) bis(benzoxazoles) of the formula

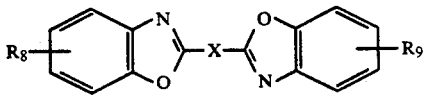

(5)

in which $R_8$ and $R_9$, independently of one another, are each H or $C_1$–$C_6$alkyl and X is vinylene, thienylene, naphthylene, styrylene or stilbenylene;

f) coumarins of the formula

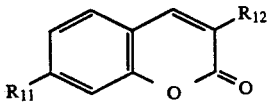

(6)

in which $R_{11}$ and $R_{12}$, independently of one another, are each a phenyl or pyrazolyl radical or a radical of the formula

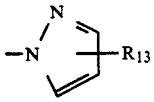

(7)

or

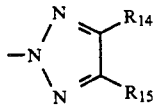

(8)

in which $R_{13}$ is $C_1$–$C_6$alkyl, phenyl or halogen and $R_{14}$ and $R_{15}$, independently of one another are each $C_1$–$C_6$alkyl or -alkoxy, phenyl or halogen, or in which $R_{14}$ and $R_{15}$ together with the two C atoms linking them are a phenyl or naphthyl radical;

g) naphthalimides of the formula

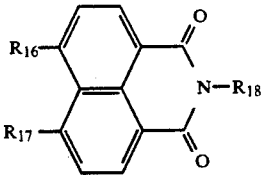

(9)

in which $R_{16}$, $R_{17}$ and $R_{18}$, independently of one another, are each H, $C_1$–$C_{10}$alkyl or -alkoxy;

h) triazines of the formula

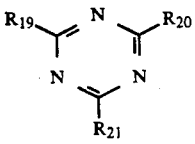

(10)

or

-continued

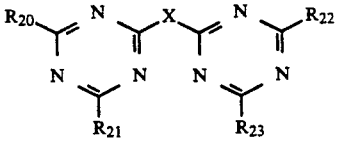

(11)

in which $R_{19}$ is pyrenyl, $R_{20}$, $R_{21}$, $R_{22}$ and $R_{23}$, independently of one another, are each $C_1$–$C_6$alkoxy, phenyl, $C_1$–$C_4$alkylphenyl or $C_1$–$C_4$alkoxyphenyl and X is vinylene, thienylene, napthylene, styrylene or stilbenylene;

i) styrylbenzoxazoles of the formula

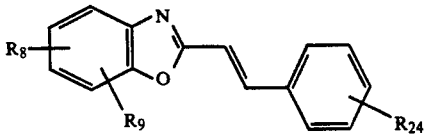

(12)

in which $R_8$ and $R_9$, independently of one another, are each H or $C_1$–$C_4$alkyl and $R_{24}$ is CN, phenyl or $COOC_1$–$C_4$alkyl;

j) distyrylbiphenyls of the formula

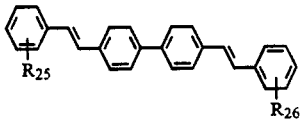

(13)

in which $R_{25}$ and $R_{26}$ are each H, $C_1$–$C_4$alkyl or -alkoxy.

4. A process according to claim 3, wherein the fluorescent whitening agent used is a distyrylbenzene of the formula (1), in which $R_1$ and $R_2$ are each CN.

5. A process according to claim 3, wherein the fluorescent whitening agent used is a vinylstilbene of the formula (2), in which $R_3$ and $R_4$ are each $COOC_1$–$C_4$alkyl.

6. A process according to claim 3, wherein the fluorescent whitening agent used is a stilbenylnaphthotriazole of the formula (3), in which $R_5$, $R_6$ and $R_7$, independently of one another are each H or CN.

7. A process according to claim 3, wherein the fluorescent whitening agent used is a stilbenylbenzoxazole of the formula (4), in which $R_8$ and $R_9$, independently of one another, are each $C_1$–$C_4$alkyl and $R_{10}$ is $C_1$–$C_4$alkyl or phenyl.

8. A process according to claim 3, wherein the fluorescent whitening agent used is a bis(benzoxazole) of the formula (5), in which $R_8$ and $R_9$, independently of one another, are each H or $C_1$–$C_4$alkyl and X is vinylene, thienylene or naphthylene, styrylene or stilbenylene.

9. A process according to claim 3, wherein the fluorescent whitening agent used is a coumarin of the formula (6), in which $R_{11}$ is naphthotriazolyl, phenyltriazolyl, phenylmethyltriazolyl or methylpyrazolyl and $R_{12}$ is phenyl or chloropyrazolyl.

10. A process according to claim 3, wherein the fluorescent whitening agent used is a naphthalimide of the formula (9), in which $R_{16}$ and $R_{17}$, independently of one another, are each $C_1$–$C_4$alkoxy and $R_{18}$ is $C_1$–$C_4$alkyl.

11. A process according to claim 3, wherein the fluorescent whitening agent used is a triazine of the formula (10), in which $R_{19}$ is pyranyl and $R_{20}$ and $R_{21}$, independently of one another, are each $C_1$–$C_4$alkoxy, or of the formula (11), in which $R_{20}$, $R_{21}$, $R_{22}$ and $R_{23}$, independently of one another, are each phenyl and X is stilbenylene.

12. A process according to claim 3, wherein the fluorescent whitening agent used is a styrylbenzoxazole of the formula (12), in which $R_8$ and $R_9$, independently of one another, are each $C_1$–$C_4$alkyl and $R_{24}$ is $COOC_1$–$C_4$alkyl.

13. A process according to claim 3, wherein the fluorescent whitening agent used is a distyrylbiphenyl of the formula (13), in which $R_{25}$ and $R_{26}$, independently of one another, are each $C_1$–$C_4$alkoxy.

14. A process according to claim 1, wherein a fluorescent whitening agent is used which is free of diluents and dispersants.

15. A process according to claim 1, wherein the fluorescent whitening is carried out at temperatures of between about 90° C. and about 200° C.

16. A process according to claim 1, wherein the fluorescent whitening is carried out at a pressure of between about 73 bar and about 400 bar.

17. A process according to claim 1, wherein the substrate is subjected to fluorescent whitening at a liquor ratio of about 2:1 to about 100:1.

18. A process according to claim 1, wherein the supercritical $CO_2$ used is purified after the fluorescent whitening and used again for whitening.

19. A process according to claim 18, wherein the supercritical $CO_2$ is purified by means of a filter.

20. A process according to claim 18, wherein the supercritical $CO_2$ is purified by a decrease in temperature and/or pressure and/or increase in volume.

21. A process of claim 15 wherein the temperature is between about 100° C. and about 150° C.

22. A process of claim 16 wherein the pressure is between about 150 bar and about 250 bar.

23. A process of claim 17 wherein the liquor ratio is between about 5:1 and about 75:1.

24. A process of claim 1 wherein the textile material is polyester.

25. An hydrophobic textile material subjected to fluorescent whitening by the process according to claim 1.

* * * * *